US011828522B2

(12) United States Patent
Kondo et al.

(10) Patent No.: US 11,828,522 B2
(45) Date of Patent: Nov. 28, 2023

(54) CRYOGENIC REFRIGERATOR AND BIOMAGNETIC MEASUREMENT APPARATUS

(71) Applicants: Jun Kondo, Ishikawa (JP); Kunio Kazami, Ishikawa (JP); Hiroshi Kubota, Ishikawa (JP); Shunichi Matsumoto, Ishikawa (JP); Takahiro Umeno, Tokyo (JP); Syoji Takami, Tokyo (JP); Takuji Ito, Tokyo (JP)

(72) Inventors: Jun Kondo, Ishikawa (JP); Kunio Kazami, Ishikawa (JP); Hiroshi Kubota, Ishikawa (JP); Shunichi Matsumoto, Ishikawa (JP); Takahiro Umeno, Tokyo (JP); Syoji Takami, Tokyo (JP); Takuji Ito, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 47 days.

(21) Appl. No.: 17/207,967

(22) Filed: Mar. 22, 2021

(65) Prior Publication Data

US 2021/0293467 A1 Sep. 23, 2021

(30) Foreign Application Priority Data

Mar. 23, 2020 (JP) ..... 2020-051836

(51) Int. Cl.
*F25D 19/00* (2006.01)
*H01F 6/04* (2006.01)

(52) U.S. Cl.
CPC ..... *F25D 19/006* (2013.01); *H01F 6/04* (2013.01)

(58) Field of Classification Search
CPC ..... F25D 19/006; H01F 6/04
USPC ..... 62/51.1
See application file for complete search history.

(56) References Cited

U.S. PATENT DOCUMENTS

| | | | | |
|---|---|---|---|---|
| 5,018,359 | A * | 5/1991 | Horikawa | G01R 33/3815 62/297 |
| 2002/0050815 | A1* | 5/2002 | Suzuki | G01R 33/24 324/248 |
| 2006/0097146 | A1* | 5/2006 | Strobel | G01R 33/31 324/318 |
| 2018/0094837 | A1 | 4/2018 | Morie | |
| 2019/0011170 | A1 | 1/2019 | Morie | |
| 2019/0059758 | A1 | 2/2019 | Yamaga et al. | |

FOREIGN PATENT DOCUMENTS

| | | | |
|---|---|---|---|
| JP | 2002-232030 | A | 8/2002 |
| JP | 2017-015620 | A | 1/2017 |
| JP | 2018-059646 | A | 4/2018 |
| JP | 2019-015466 | A | 1/2019 |
| JP | 6602456 | B2 | 11/2019 |

* cited by examiner

*Primary Examiner* — Nael N Babaa
(74) *Attorney, Agent, or Firm* — Harness, Dickey & Pierce, P.L.C.

(57) ABSTRACT

A cryogenic refrigerator includes a cooling unit and a magnetic shielding unit. The cooling unit is configured to cool a refrigerant. The magnetic shielding unit covers around the cooling unit.

17 Claims, 9 Drawing Sheets

CRYOGENIC REFRIGERATOR AND BIOMAGNETIC MEASUREMENT APPARATUS

CROSS-REFERENCE TO RELATED APPLICATIONS

The present application claims priority under 35 U.S.C. § 119 to Japanese Patent Application No. 2020-051836, filed on Mar. 23, 2020. The contents of which are incorporated herein by reference in their entirety.

BACKGROUND OF THE INVENTION

1. Field of the Invention

The present invention relates to a cryogenic refrigerator and a biomagnetic measurement apparatus.

2. Description of the Related Art

Conventionally, for example, techniques of reducing influence of magnetic noise by arranging a magnetic shielding member in a cryogenic refrigerator are described in Japanese Unexamined Patent Application Publication No. 2019-015466 and Japanese Unexamined Patent Application Publication No. 2018-059646, for example.

In a biomagnetic measurement apparatus, such as magnetoencephalography or magnetospinography, for example, a high sensitive magnetic sensor, such as a superconducting quantum interference device, is used in some cases, and liquid helium is used as a refrigerant to maintain a superconductive state. Alternatively, liquid helium is used as a refrigerant even in a cryogenic physical property measurement apparatus. Liquid helium is easily turned into gas, so that it is necessary to circulate helium by using a cryogenic refrigerator in order to economically and continuously perform measurement in the apparatuses as described above.

Here, in the cryogenic refrigerator, a cooling unit (cold head) and a heat-retention unit (cryostat) that houses the cooling unit are generally made of metal and have magnetic property, so that a magnetostatic field distribution is generated in a peripheral space. Further, in a pulse pipe refrigerator that is a cryogenic refrigerator, mechanical vibration occurs during operation.

Then, if a magnetic member vibrates, magnetic field variation that is proportional to vibration amplitude occurs in the peripheral space, which leads to measurement noise in a biomagnetic measurement apparatus or the like.

SUMMARY OF THE INVENTION

A cryogenic refrigerator includes a cooling unit and a magnetic shielding unit. The cooling unit is configured to cool a refrigerant. The magnetic shielding unit covers around the cooling unit.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
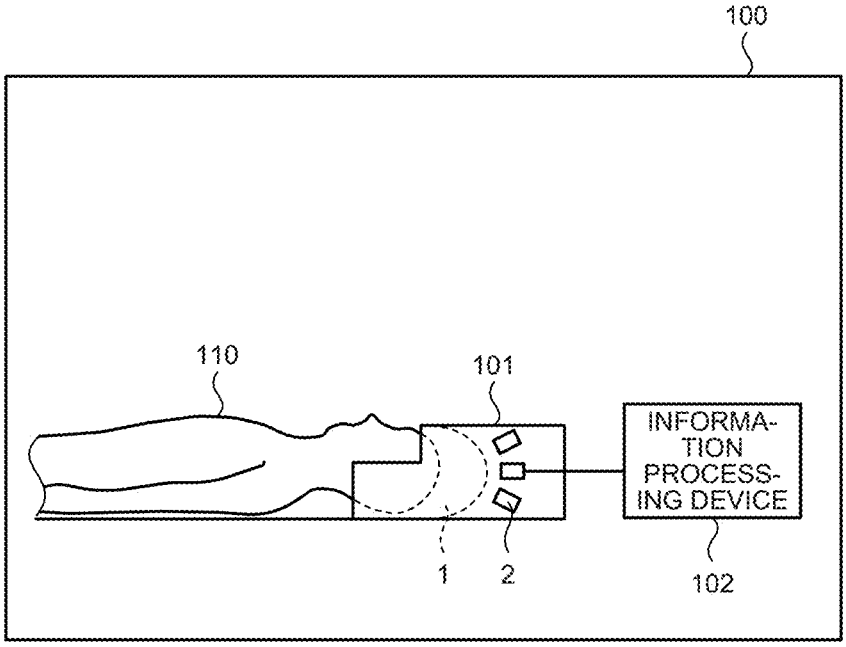
FIG. 1 is an overall configuration diagram illustrating an example of a biomagnetic measurement apparatus.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment has an object to prevent influence of a variable magnetic field generated by vibration.

Embodiments of a cryogenic refrigerator and a biomagnetic measurement apparatus will be described in detail below with reference to the accompanying drawings.

FIG. 1 is an overall configuration diagram illustrating an example of a biomagnetic measurement apparatus.

A biomagnetic measurement apparatus 100 is a biological information measurement device and includes a brain function measurement device (also referred to as a measurement device) 101 and an information processing device 102.

The brain function measurement device 101 is magnetoencephalography that measures a magnetoencephalography (MEG) signal of a brain that is an organ of a subject 110 that is a measurement target. The brain function measurement device 101 includes a dewar 1 in which a head of the subject 110 is inserted. The dewar 1 is a helmet-type dewar with a built-in sensor, and surrounds almost the entire region of the head of the subject 110. The dewar 1 is a vacuum insulation device in a cryogenic environment using liquid helium. The dewar 1 includes, inside thereof, a number of magnetic sensors 2 for magnetoencephalography. As the magnetic sensors 2, superconducting quantum interference devices (SQUIDs) are used. The brain function measurement device 101 collects magnetoencephalography signals from the magnetic sensors 2. The brain function measurement device 101 outputs the collected biological signals to the information processing device 102.

The information processing device 102 displays waveforms of the magnetoencephalography signals obtained from the plurality of magnetic sensors 2 on a time axis. The magnetoencephalography signals represent micro magnetic field variation that has occurred due to brain electrical activity.

Figure 2:
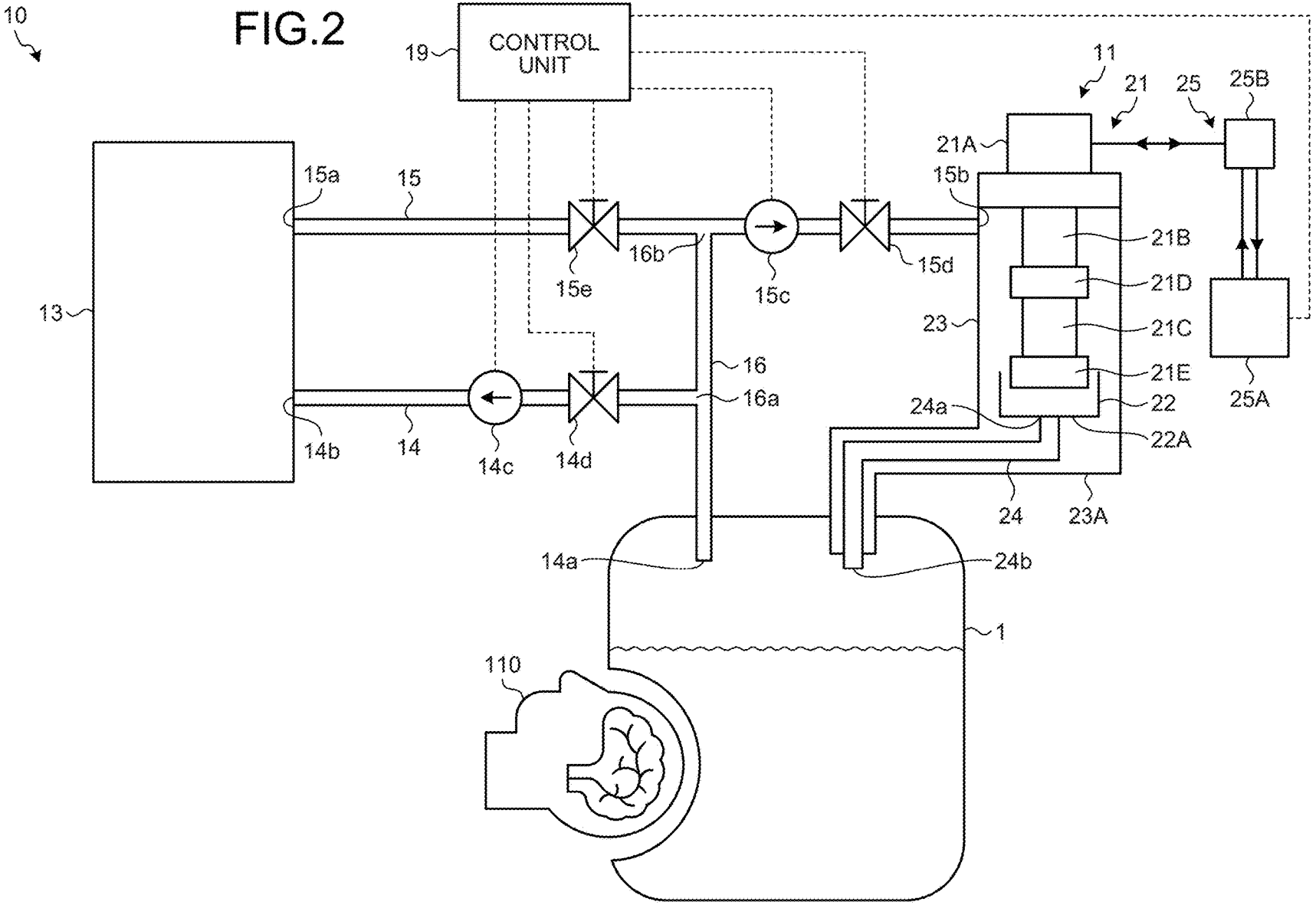
FIG. 2 is an overall configuration diagram illustrating an example of a helium circulation system.

FIG. 2 is an overall configuration diagram illustrating an example of a helium circulation system.

The brain function measurement device 101 as described above includes a helium circulation system 10 that realizes a cryogenic environment in the dewar 1 that is a vacuum insulation device. The helium circulation system 10 includes a cryogenic refrigerator 11, the dewar 1, an evaporation gas collecting unit (buffer tank) 13, an evaporation gas collecting pipe 14, a stored gas supply pipe 15, a circulation pipe 16, and a control unit 19.

The cryogenic refrigerator 11 constitutes a pulse pipe refrigerator and includes a cooling unit 21, a receiving unit 22, a heat-retention unit 23, a transmission pipe 24, and a driving system circulation unit 25.

The cooling unit 21 includes a main body portion 21A, a cylindrical first cylinder portion 21B, a cylindrical second cylinder portion 21C, a discoid first cold stage 21D, and a discoid second cold stage 21E. The main body portion 21A is a basal portion of the cooling unit 21 and arranged in the uppermost part. The first cylinder portion 21B is arranged so as to extend downward from the main body portion 21A. The second cylinder portion 21C is arranged so as to extend downward relative to the first cylinder portion 21B. The first cold stage 21D is arranged between the first cylinder portion 21B and the second cylinder portion 21C. The second cold stage 21E is arranged at an extended lower end of the second cylinder portion 21C.

The receiving unit 22 is formed in a plate shape such that an upper end thereof is opened and a bottom 22A is formed at a lower end. The receiving unit 22 is arranged just below the cooling unit 21.

The heat-retention unit 23 is a vacuum insulation cryostat, and is formed in a tubular shape with stainless steel or glass-fiber reinforced resin such that an upper end thereof is opened and a bottom 23A is formed at a lower end. The heat-retention unit 23 is arranged so as to house the cooling unit 21 and surround an outer periphery of the cooling unit 21 with a space interposed between the heat-retention unit 23 and the cooling unit 21. An upper end of the heat-retention unit 23 is tightly sealed with the main body portion 21A of the cooling unit 21. Further, the receiving unit 22 is arranged inside the heat-retention unit 23. The heat-retention unit 23 functions to maintain internal temperature.

The transmission pipe 24 is arranged such that an upper end 24*a* is connected to the bottom 22A of the receiving unit 22 so as to communicate with the receiving unit 22. The transmission pipe 24 extends downward from the bottom 22A of the receiving unit 22 and a lower end 24*b* is arranged downward through the inside of the heat-retention unit 23. The heat-retention unit 23 is arranged so as to extend downward along with the transmission pipe 24 such that the bottom 23A surrounds an outer periphery of the transmission pipe 24 with a space interposed between the bottom 23A and the transmission pipe 24. The lower end 24*b* of the transmission pipe 24 is connected to the dewar 1 of the brain function measurement device 101. The transmission pipe 24 is also referred to as a first path for feeding a liquid refrigerant from the cooling unit 21 to the dewar 1.

The driving system circulation unit 25 includes a compression machine 25A as a compressor, and a valve motor 25B as an operating unit. The compression machine 25A compresses compressed gas. The compressed gas is, for example, helium gas. The compressed gas that is compressed by the compression machine 25A is supplied to the valve motor 25B. The valve motor 25B switches between open and close states so as to intermittently supply the compressed gas to the main body portion 21A of the cooling unit 21. The driving system circulation unit 25 causes the compressed gas to circulate between the compression machine 25A and the cooling unit 21 by switching the valve motor 25B. The cooling unit 21 is activated by being intermittently supplied with the compressed gas, and generates cold at the first cold stage 21D and the second cold stage 21E. Meanwhile, the compression machine 25A exhausts heat by water cooling or air cooling.

In the cryogenic refrigerator 11, at the time of activation, a gas refrigerant is supplied to the cooling unit 21 inside the heat-retention unit 23. The gas refrigerant is, for example, helium gas, is liquefied and turned into liquid helium that is a liquid refrigerant by being cooled by cold that is generated at the first cold stage 21D and the second cold stage 21E, and is collected by falling in drops on the bottom 22A of the receiving unit 22. The liquid helium collected on the bottom 22A of the receiving unit 22 is fed to the outside of the cryogenic refrigerator 11 through the transmission pipe 24, and is supplied to a helium tank inside the dewar 1 of the brain function measurement device 101. Accordingly, the liquid helium is held in the dewar 1 of the brain function measurement device 101. The liquid helium inside the dewar 1 is turned into helium gas (also referred to as evaporation gas) by being gradually evaporated by heat coming from outside.

The evaporation gas collecting unit 13 is a pressure container for collecting, storing, and retaining the evaporation gas that is evaporated in the dewar 1.

The evaporation gas collecting pipe 14 is a pipe for connecting the dewar 1 and the evaporation gas collecting unit 13. One end 14*a* of the evaporation gas collecting pipe 14 is connected to the dewar 1, and another end 14*b* is connected to the evaporation gas collecting unit 13. The evaporation gas collecting pipe 14 includes a pump 14*c* that is a compressor in a middle portion of the evaporation gas collecting pipe 14 in order to feed the evaporation gas from the dewar 1 to the evaporation gas collecting unit 13. Further, the evaporation gas collecting pipe 14 includes an open-close valve 14*d* at the side of the one end 14*a* relative to the pump 14*c* in order to switch between transmission and non-transmission of the evaporation gas. The open-close valve 14*d* is controlled by the control unit 19. The evaporation gas collecting pipe 14 is also referred to as a second path for feeding the evaporation gas from the dewar 1 to the evaporation gas collecting unit 13.

The stored gas supply pipe 15 is a pipe for connecting the evaporation gas collecting unit 13 and the cooling unit 21. One end 15*a* of the stored gas supply pipe 15 is connected to the evaporation gas collecting unit 13, and another end 15*b* is connected to the cooling unit 21 of the cryogenic refrigerator 11. The stored gas supply pipe 15 includes a pump 15*c* in a middle portion of the stored gas supply pipe 15 in order to feed the evaporation gas (retained gas) that is retained in the evaporation gas collecting unit 13 from the evaporation gas collecting unit 13 to the cooling unit 21. Further, the stored gas supply pipe 15 includes an open-close valve 15*d* at the side of the other end 15*b* relative to the pump 15*c* in order to switch between transmission and non-transmission of the evaporation gas. The open-close valve 15*d* is controlled by the control unit 19. Furthermore, the stored gas supply pipe 15 includes an open-close valve

15*e* at the side of the one end 15*a* relative to the pump 15*c* in order to switch between transmission and non-transmission of the evaporation gas. The open-close valve 15*e* is controlled by the control unit 19. The stored gas supply pipe 15 is also referred to as a third path for feeding the evaporation gas from the evaporation gas collecting unit 13 to the cooling unit 21.

The circulation pipe 16 is a pipe for connecting the middle portion of the evaporation gas collecting pipe 14 and the middle portion of the stored gas supply pipe 15. One end 16*a* of the circulation pipe 16 is connected to a portion between the one end 14*a* of the evaporation gas collecting pipe 14 and the pump 14*c*, and another end 16*b* is connected to a portion between the open-close valve 15*e* of the stored gas supply pipe 15 and the pump 15*c*. The circulation pipe 16 is also referred to as a bypass path for directly feeding the evaporation gas from the dewar 1 to the cooling unit 21.

The control unit 19 is an arithmetic device that controls the helium circulation system 10 and includes a central processing unit (CPU), a storage device, and the like. The control unit 19 controls operation of the compression machine 25A of the cryogenic refrigerator 11, the pump 14*c* and the open-close valve 14*d* of the evaporation gas collecting pipe 14, and the pump 15*c*, the open-close valve 15*d*, and the open-close valve 15*d* of the stored gas supply pipe 15.

Figure 3:
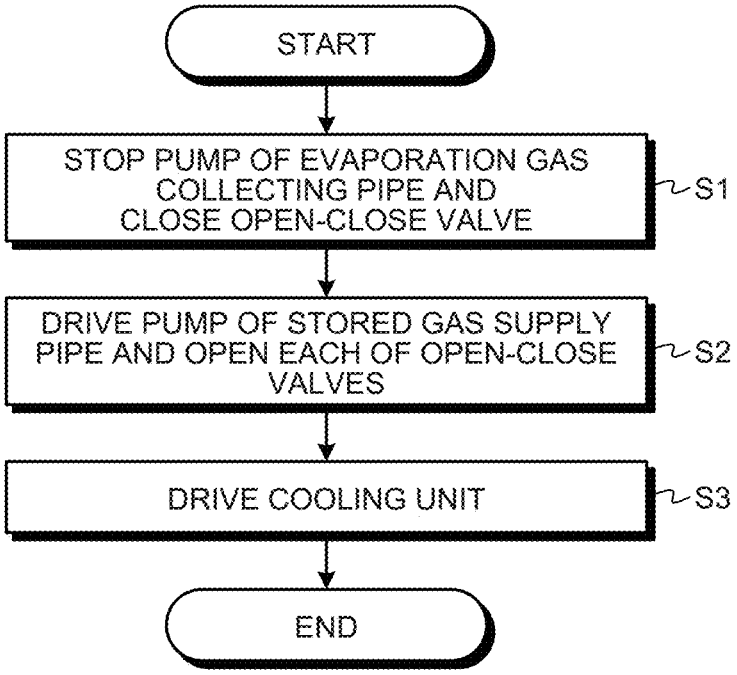
FIG. 3 is a flowchart of a process that is performed when a cryogenic refrigerator of the helium circulation system is driven.
Figure 4:
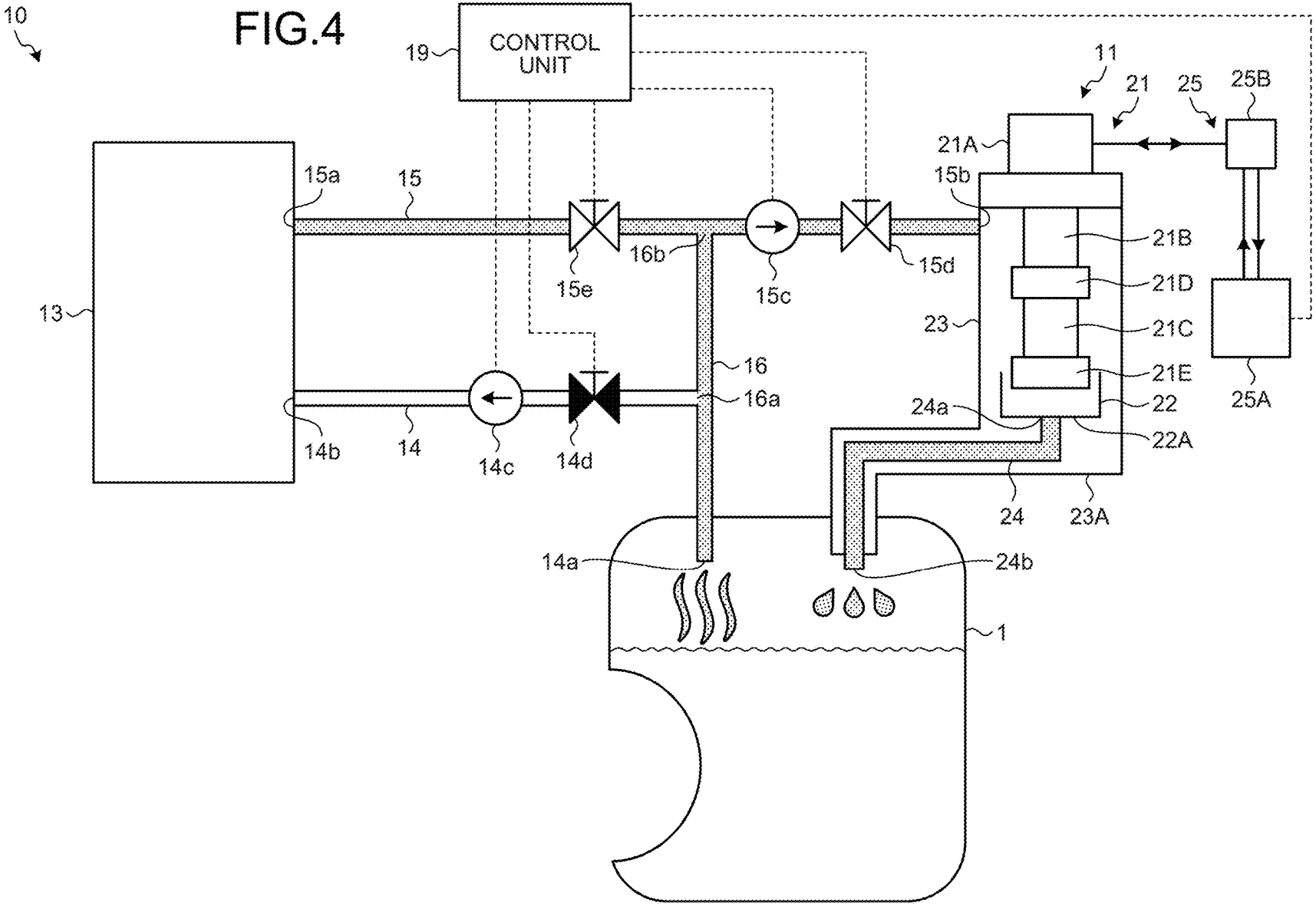
FIG. 4 is a diagram illustrating operation that is performed when cryogenic refrigerator of the helium circulation system is driven.
Figure 5:
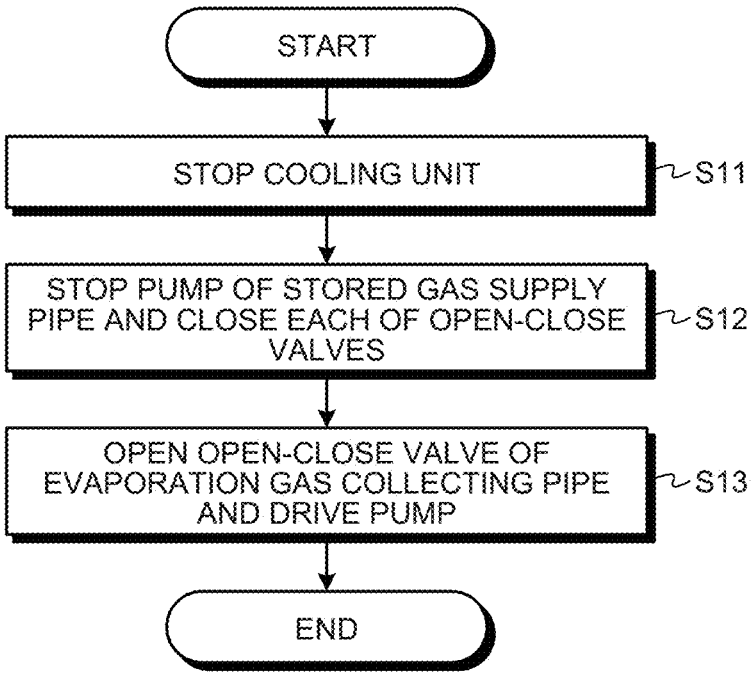
FIG. 5 is a flowchart of a process that is performed when the cryogenic refrigerator of the helium circulation system is stopped.
Figure 6:
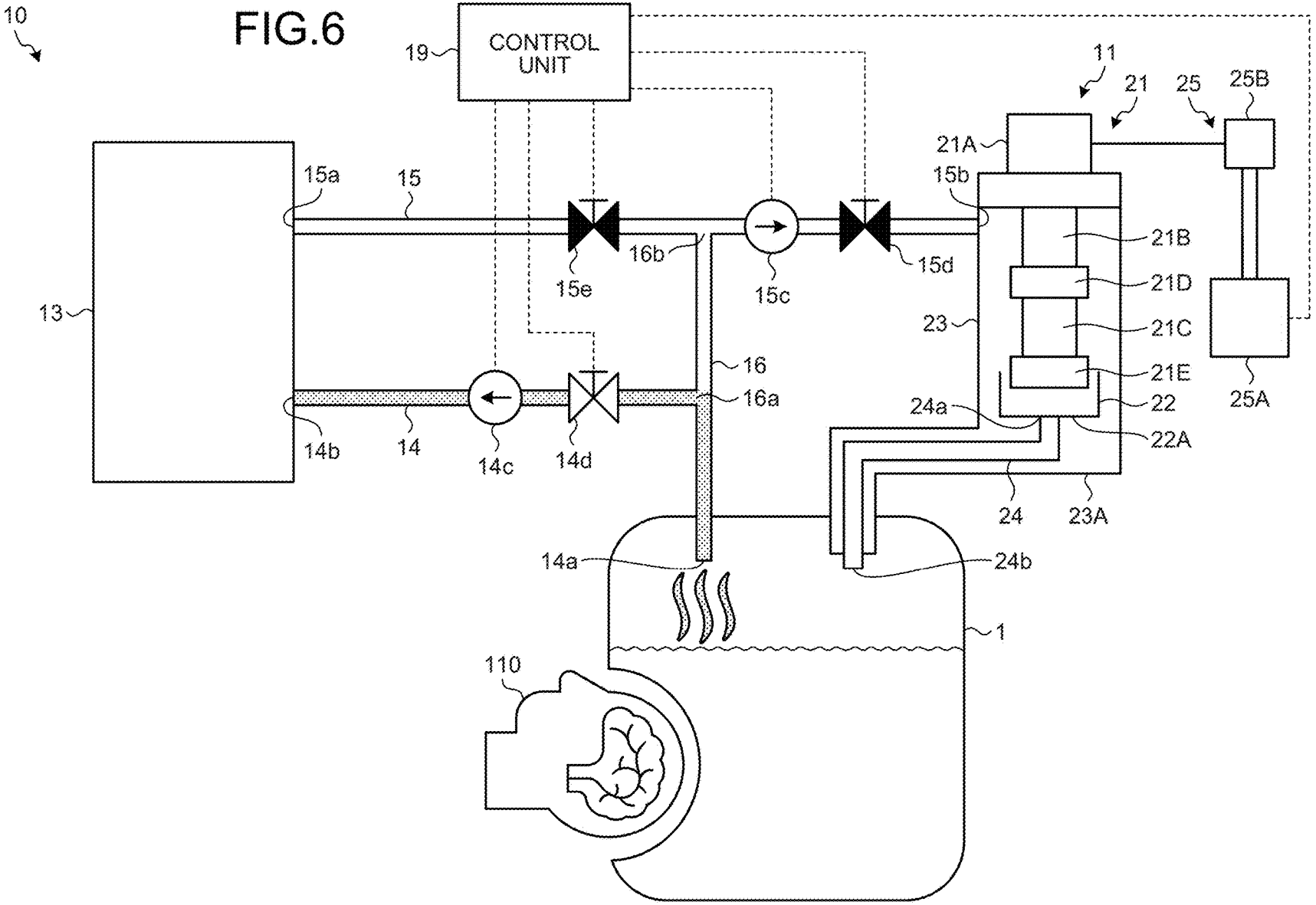
FIG. 6 is a diagram illustrating operation that is performed when the cryogenic refrigerator of the helium circulation system is stopped.

Operation of the helium circulation system 10 will be described below. FIG. 3 is a flowchart of a process that is performed when the cryogenic refrigerator of the helium circulation system is driven. FIG. 4 is a diagram illustrating operation that is performed when the cryogenic refrigerator of the helium circulation system is driven. FIG. 5 is a flowchart of a process that is performed when the cryogenic refrigerator of the helium circulation system is stopped. FIG. 6 is a diagram illustrating operation that is performed when the cryogenic refrigerator of the helium circulation system is stopped.

As illustrated in FIG. 3, when the cryogenic refrigerator 11 is driven, the control unit 19 stops the pump 14*c* of the evaporation gas collecting pipe 14 and closes the open-close valve 14*d* (Step S1). Further, the control unit 19 drives the pump 15*c* of the stored gas supply pipe 15 and opens the open-close valve 15*d* and the open-close valve 15*e* (Step S2). Then, the control unit 19 drives the cooling unit 21 of the cryogenic refrigerator 11 (Step S3). Accordingly, as illustrated in FIG. 4, the helium circulation system 10 feeds the evaporation gas from the evaporation gas collecting unit 13 to the cooling unit 21 via the stored gas supply pipe 15, feeds the evaporation gas from the dewar 1 to the cooling unit 21 via a part of the evaporation gas collecting pipe 14 and the circulation pipe 16, cools the evaporation gas in the cooling unit 21 to form a liquid refrigerant, and feeds the liquid refrigerant to the dewar 1. Meanwhile, the operation from Step S1 to Step S3 may be performed simultaneously.

Furthermore, as illustrated in FIG. 5, when the cryogenic refrigerator 11 is stopped, the control unit 19 stops the cooling unit 21 of the cryogenic refrigerator 11 (Step S11). Moreover, the control unit 19 stops the pump 15*c* of the stored gas supply pipe 15 and closes the open-close valve 15*d* and the open-close valve 15*e* (Step S12). Furthermore, the control unit 19 opens the open-close valve 14*d* of the evaporation gas collecting pipe 14 and drives the pump 14*c* (Step S13). Accordingly, as illustrated in FIG. 6, the helium circulation system 10 feeds the evaporation gas from the dewar 1 to the evaporation gas collecting unit 13 via the evaporation gas collecting pipe 14, and collects the evaporation gas by the evaporation gas collecting unit 13. Meanwhile, the operation from Step S11 to Step S13 may be performed simultaneously.

In the helium circulation system 10 of the present embodiment, for example, if the brain function measurement device 101 is not used from 5 p.m. to 9 a.m. the next day, the operation as illustrated in FIG. 3 and FIG. 4 is performed to cool the evaporation gas by the cooling unit 21 for forming a liquid refrigerant, and to feed the liquid refrigerant to the dewar 1. Further, in the helium circulation system 10 of the present embodiment, for example, if the brain function measurement device 101 is used from 9 a.m. to 5 p.m., the operation illustrated in FIG. 5 and FIG. 6 is performed to feed the evaporation gas from the dewar 1 to the evaporation gas collecting unit 13, and to collect the evaporation gas by the evaporation gas collecting unit 13. Therefore, the helium circulation system 10 of the present embodiment stops the cryogenic refrigerator 11 when measurement is performed using the brain function measurement device 101 to thereby prevent influence of vibration of the cryogenic refrigerator 11 on the brain function measurement device 101, and drives the cryogenic refrigerator 11 when measurement is not performed and the brain function measurement device 101 is not used to thereby realize the cryogenic environment in the dewar 1.

Figure 7:
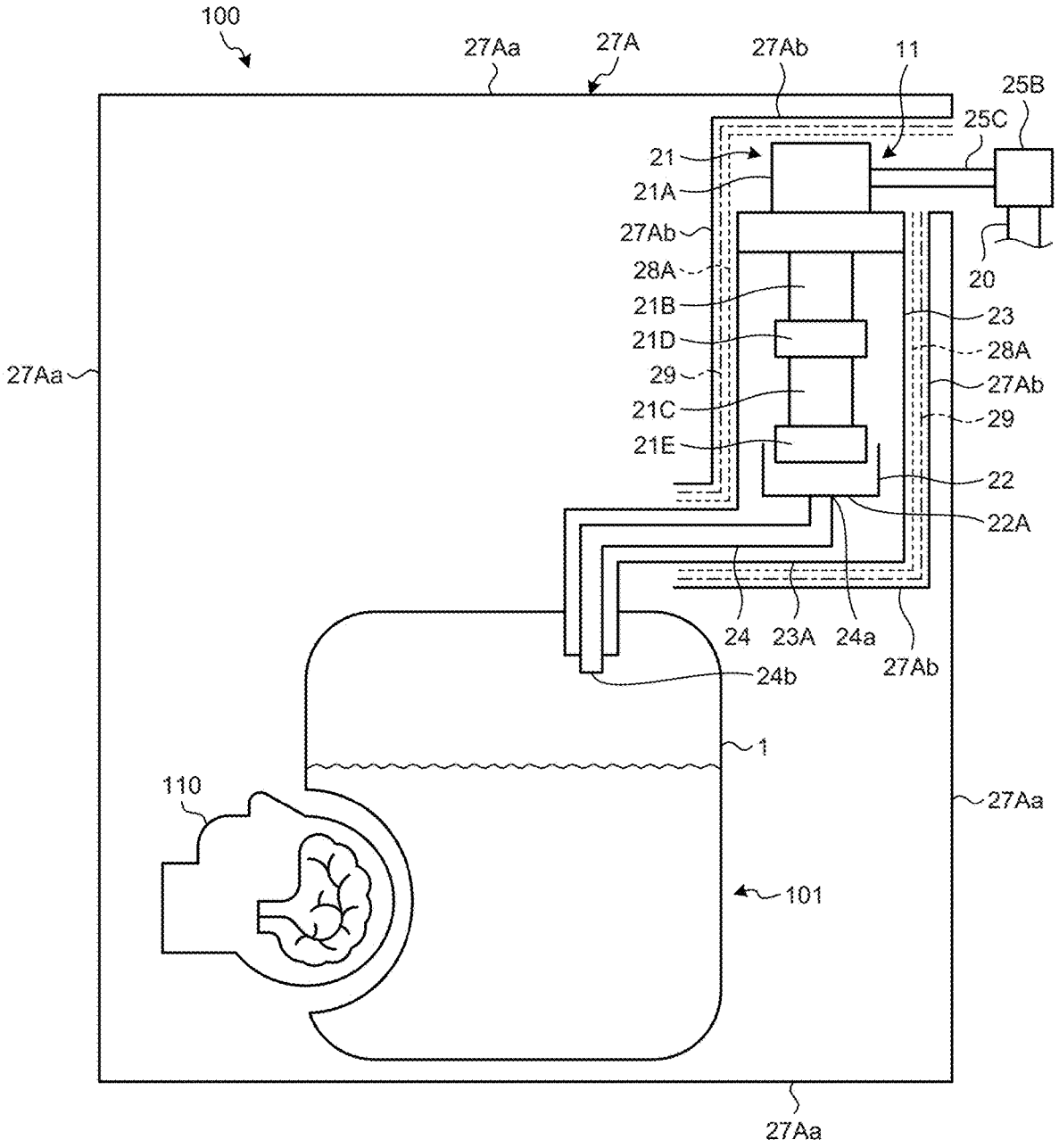
FIG. 7 is an enlarged view of a main part of the cryogenic refrigerator.
Figure 8:
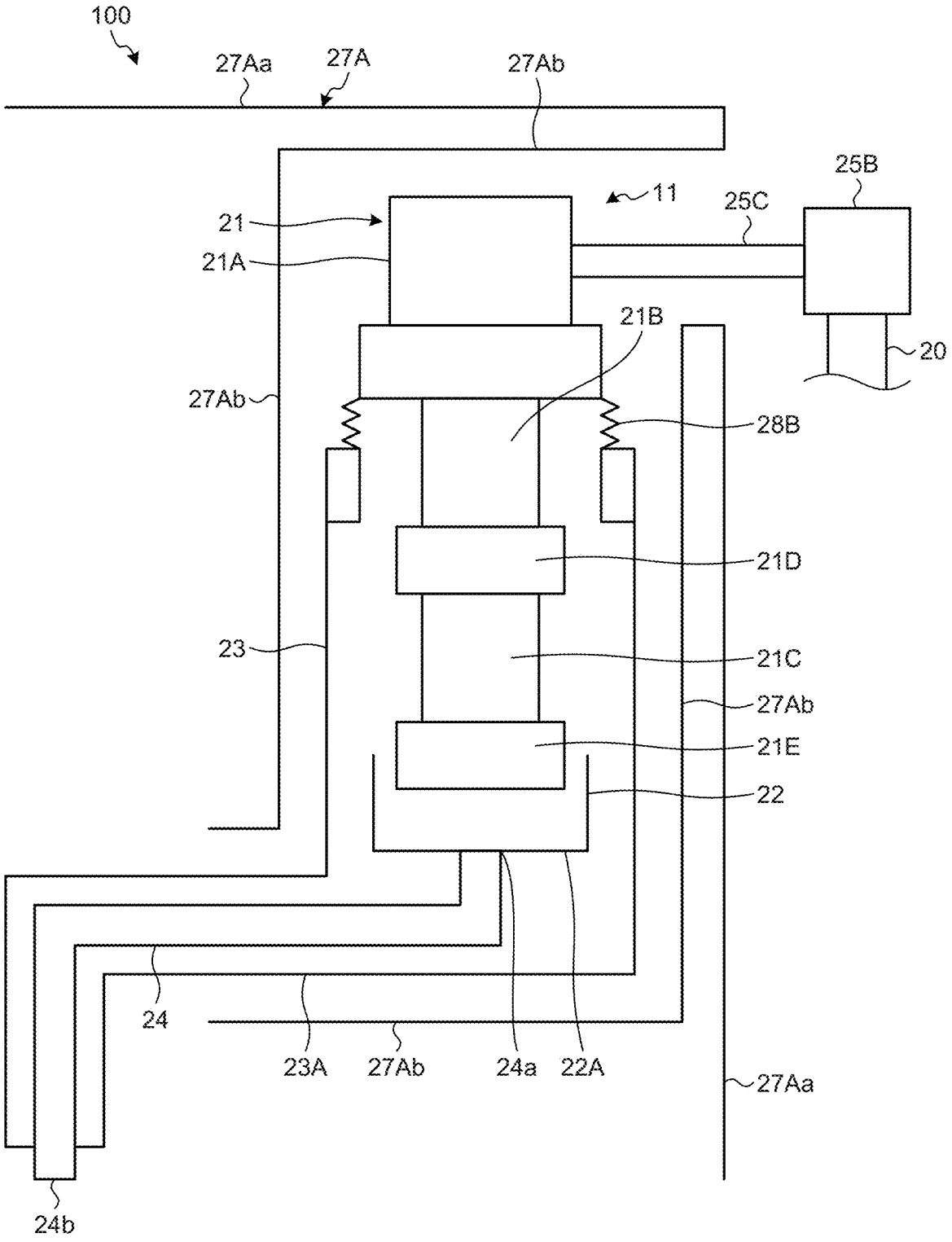
FIG. 8 is an enlarged view of the main part of the cryogenic refrigerator.
Figure 9:
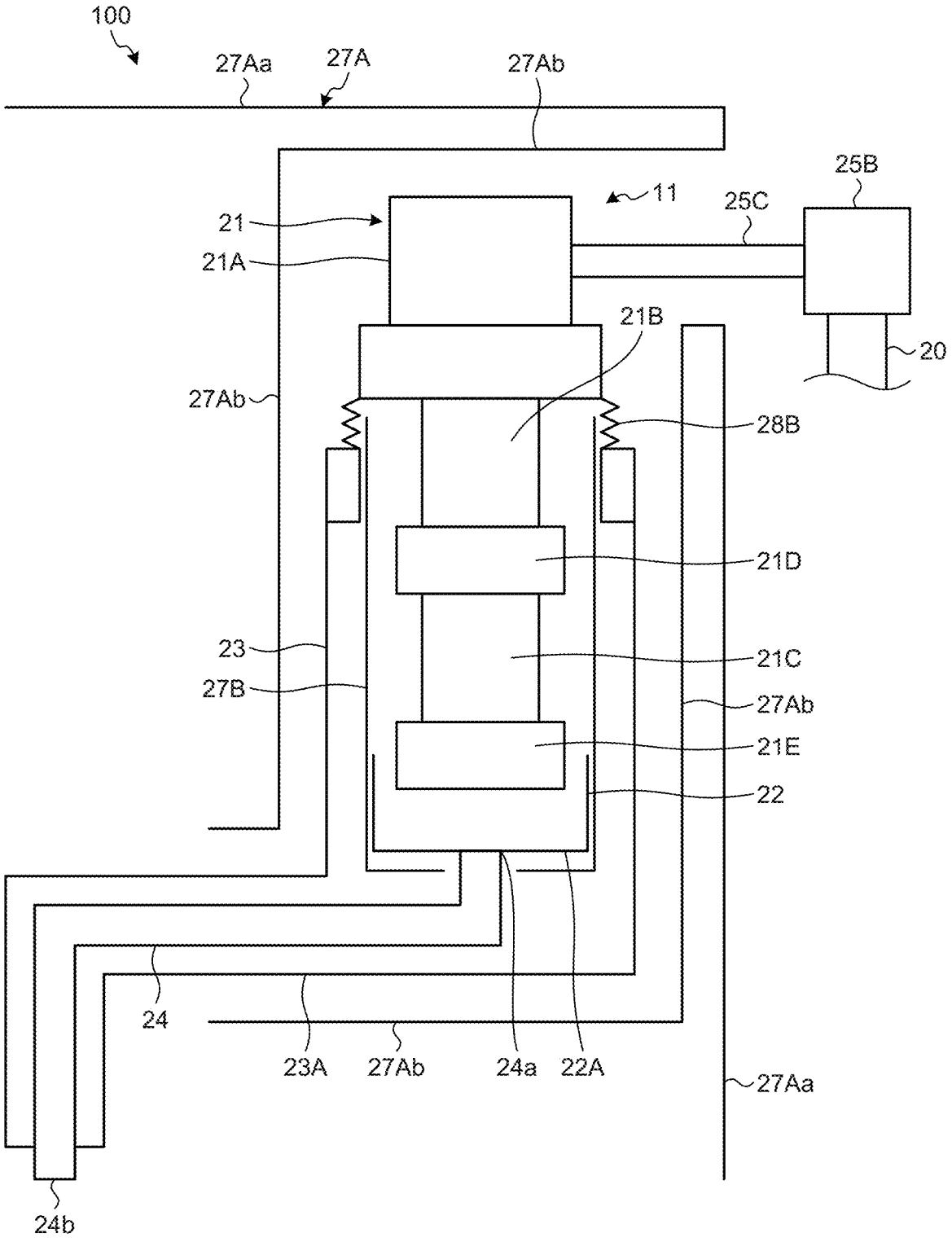
FIG. 9 is an enlarged view of the main part of the cryogenic refrigerator.

FIG. 7 to FIG. 9 are enlarged views of a main part of the cryogenic refrigerator.

As illustrated in FIG. 7 to FIG. 9, the cryogenic refrigerator 11 of the present embodiment includes the valve motor 25B as the operating unit that, when driving, supplies a compressed gas refrigerant, which is compressed, to the cooling unit 2. The valve motor 25B is fixed to a fixed portion, such as a floor or a wall, via a rigid support unit 20. The valve motor 25B is connected to the cooling unit 21 by a pressure pipe (pipe) 25C, and switches high-pressure compressed gas with respect to the cooling unit 21 via the pressure pipe 25C. By the switching of the valve motor 25B, the compressed gas moves back and forth, in a pulsed manner, in the pressure pipe 25C between the cooling unit 21 and the valve motor 25B. Accordingly, the cryogenic refrigerator 11 is driven. As the pressure pipe 25C, a flexible pipe may be used. With use of the pressure pipe 25C, the cooling unit 21 and the valve motor 25B are separated, so that it is possible to prevent vibration. However, even if the valve motor 25B that is a physical driving unit is separated from the cooling unit 21, the pressure pipe 25C expands and contracts due to pressure vibration. The expansion and contraction operation of the pressure pipe 25C causes the cooling unit 21 and the heat-retention unit 23 to vibrate, so that magnetic noise caused by mechanical displacement occurs, which leads to measurement noise in the biomagnetic measurement apparatus 100.

To cope with this, the cryogenic refrigerator 11 illustrated in FIG. 7 includes a magnetic shielding unit 27A. The magnetic shielding unit 27A is made of a high magnetic permeability soft magnetic material, such as permalloy. The magnetic shielding unit 27A includes, in the biomagnetic measurement apparatus 100, a first magnetic shielding unit 27Aa that serves as a wall of a magnetic shielding room in which the brain function measurement device 101 as the measurement device is installed, and that covers around the brain function measurement device 101. Further, the magnetic shielding unit 27A includes a second magnetic shielding unit 27Ab that convers around the cryogenic refrigerator 11, and that mainly covers the outside of the heat-retention unit 23. The second magnetic shielding unit 27Ab is configured as the magnetic shielding room together with the first magnetic shielding unit 27Aa, and covers around the cryogenic refrigerator 11 in a portion outside the magnetic shielding room in the brain function measurement device 101. With this, the cryogenic refrigerator 11 of the present embodiment is arranged such that the cooling unit 21 is covered around with the second magnetic shielding unit 27Ab, so as to be separated from the brain function measurement device 101 that is installed in the magnetic shielding room.

The circumference of the cryogenic refrigerator 11 covered with the magnetic shielding unit 27A (the second magnetic shielding unit 27Ab) is magnetically shielded. With this configuration, even if a magnetic field that varies due to vibration is generated, the cryogenic refrigerator 11 is able to reduce extension of the variable magnetic field due to vibration, and prevent occurrence of measurement noise in the brain function measurement device 101 that is the measurement device of the biomagnetic measurement apparatus 100.

Furthermore, as illustrated in FIG. 7, the cryogenic refrigerator 11 of the present embodiment includes a vibration damping member 28A between the second magnetic shielding unit 27Ab and the cryogenic refrigerator 11. The vibration damping member 28A is made elastically deformable, and attenuates vibration that occurs in the cooling unit 21 of the cryogenic refrigerator 11 to prevent the vibration from being transmitted to the second magnetic shielding unit 27Ab. The vibration damping member 28A is configured with, for example, anti-vibration rubber, a damper, or the like. With this configuration, the cryogenic refrigerator 11 separates the second magnetic shielding unit 27Ab so as to prevent transmission of vibration, and prevents magnetic field variation caused by a residual field of the second magnetic shielding unit 27Ab.

Moreover, as illustrated in FIG. 7, the cryogenic refrigerator 11 of the present embodiment includes a vibration absorbing member 29 between the second magnetic shielding unit 27Ab and the cryogenic refrigerator 11. The vibration absorbing member 29 is configured with, for example, a urethane material, absorbs vibration that occurs in the cooling unit 21 of the cryogenic refrigerator 11, and prevents transmission of the vibration to the second magnetic shielding unit 27Ab. With this configuration, the cryogenic refrigerator 11 prevents vibration from being transmitted to the second magnetic shielding unit 27Ab, and prevents magnetic field variation caused by a residual field of the second magnetic shielding unit 27Ab.

The cryogenic refrigerator 11 illustrated in FIG. 8 includes the magnetic shielding unit 27A as described above. With this configuration, similarly to the cryogenic refrigerator 11 illustrated in FIG. 7, even if a magnetic field that varies due to vibration is generated, the cryogenic refrigerator 11 illustrated in FIG. 8 is able to reduce extension of the variable magnetic field due to vibration, and prevent occurrence of measurement noise of the brain function measurement device 101 that is the measurement device of the biomagnetic measurement apparatus 100.

Furthermore, as illustrated in FIG. 8, the cryogenic refrigerator 11 of the present embodiment includes a vibration damping member 28B between the cooling unit 21 and the heat-retention unit 23. The vibration damping member 28B is configured such that a tubular surround is formed in an accordion shape in an elastically deformable manner, allows the cooling unit 21 to be inserted therein, has one end of the tube that is fixed to the cooling unit 21 side, and has another end of the tube that is fixed so as to close the opening of the upper end of the heat-retention unit 23. In addition, the vibration damping member 28B need not always be formed in an accordion shape, but may be formed in an elastic tubular shape. The vibration damping member 28B may be configured with elastic resin or a magnesium alloy with a vibration absorbing effect. Therefore, the vibration damping member 28B attenuates vibration that occurs in the cooling unit 21 of the cryogenic refrigerator 11 through the pressure pipe 25C that is a cause of the vibration, and prevents the vibration from being transmitted to the second magnetic shielding unit 27Ab via the heat-retention unit 23. With this configuration, the cryogenic refrigerator 11 separates the second magnetic shielding unit 27Ab so as to prevent transmission of vibration, and prevents magnetic field variation caused by a residual field of the second magnetic shielding unit 27Ab.

The cryogenic refrigerator 11 illustrated in FIG. 9 can be added to the cryogenic refrigerator 11 illustrated in FIG. 8, and includes, inside the heat-retention unit 23, a tubular magnetic shielding unit 27B that covers around the cooling unit 21. The magnetic shielding unit 27B is made of a soft magnetic material, such as cryoperm, that has high magnetic permeability even at low temperature.

In the cryogenic refrigerator 11, the circumference of the cooling unit 21 covered with the magnetic shielding unit 27B is magnetically shielded. With this configuration, even if a magnetic field that varies due to vibration is generated, the cryogenic refrigerator 11 is able to reduce extension of the variable magnetic field due to vibration, and prevent occurrence of measurement noise in the brain function measurement device 101 that is the measurement device of the biomagnetic measurement apparatus 100.

Furthermore, in the cryogenic refrigerator 11 illustrated in FIG. 7 to FIG. 9, the heat-retention unit 23 is made of a non-magnetic material. Examples of the non-magnetic material include glass-fiber-reinforced plastics (GFRP). With this configuration, in the cryogenic refrigerator 11, the heat-retention unit 23 does not have magnetic property, so that magnetic field variation does not occur in a peripheral space even if vibration occurs, and it is possible to prevent occurrence of measurement noise in the biomagnetic measurement apparatus 100.

The biomagnetic measurement apparatus 100 of the present embodiment is able to, by the cryogenic refrigerator 11 as described above, prevent influence of a variable magnetic field generated by vibration, and prevent occurrence of measurement noise in the brain function measurement device 101.

Furthermore, in the biomagnetic measurement apparatus 100 of the present embodiment, with use of the second magnetic shielding unit 27Ab, the first magnetic shielding unit 27Aa is arranged outside the magnetic shielding room that is formed by the first magnetic shielding unit 27Aa that covers around the brain function measurement device 101. With this configuration, even if a magnetic field that varies due to vibration of the cryogenic refrigerator 11 is generated, the biomagnetic measurement apparatus 100 is able to reduce extension of the variable magnetic field generated by the vibration, and prevent occurrence of measurement noise in the brain function measurement device 101 that is the measurement device of the biomagnetic measurement apparatus 100.

According to an embodiment, it is possible to prevent influence of a variable magnetic field generated by vibration.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A cryogenic refrigerator comprising:

a cooling device configured to cool a gas refrigerant into a liquid refrigerant;

a magnetic shield covering the cooling device;

a transmission pipe connected to a heat-retention device, the transmission pipe configured to transmit the liquid refrigerant to a measurement device;

a gas supply pipe connected to the heat-retention device and the measurement device, the gas supply pipe configured to feed liquid refrigerant evaporated into gas form from the measurement device to the cooling device; and the heat-retention device configured to house the cooling device and the transmission pipe; and the magnetic shield is configured to cover the heat-retention device.

2. The cryogenic refrigerator according to claim 1, further comprising:

at least one vibration damper between the heat-retention device and the magnetic shield.

3. The cryogenic refrigerator according to claim 2, further comprising:

at least one vibration absorbing member between the at least one vibration damper and the magnetic shield.

4. The cryogenic refrigerator according to claim 1, further comprising:

a heat-retention device configured to house the cooling device; and the magnetic shield is arranged inside the heat-retention device and covers the cooling device.

5. The cryogenic refrigerator according to claim 4, further comprising:

a vibration damper between the cooling device and the heat-retention device.

6. The cryogenic refrigerator according to claim 1, wherein the heat-retention device is made of a non-magnetic material.

7. A biomagnetic measurement apparatus comprising:

a cryogenic refrigerator configured to cool a refrigerant; and a measurement device configured to be cooled by the refrigerant fed from the cryogenic refrigerator, wherein the cryogenic refrigerator is arranged outside a magnetic shield covering the measurement device, and the cryogenic refrigerator includes, a cooling device configured to cool the refrigerant from a gas form into a liquid form, a transmission pipe connected to a heat-retention device, the transmission pipe configured to transmit the liquid refrigerant to the measurement device;

a gas supply pipe connected to the heat-retention device and the measurement device, the gas supply pipe configured to feed liquid refrigerant evaporated into gas form from the measurement device to the cooling device;

the heat-retention device configured to house the cooling device and the transmission pipe; and the magnetic shield, the magnetic shield configured to cover the heat-retention device.

8. The cryogenic refrigerator according to claim 1, further comprising:

the transmission pipe is further configured to feed the liquid refrigerant from the cooling device to the measurement device, wherein the liquid refrigerant is used to cool the measurement device.

9. The cryogenic refrigerator according to claim 1, further comprising:

an evaporation collection tank configured to collect the evaporated refrigerant and provide the collected evaporated refrigerant to the cooling device.

10. The cryogenic refrigerator according to claim 9, further comprising:

a first path of a circulation pipe configured to feed the evaporated refrigerant from the measurement device to the evaporation collection tank.

11. The cryogenic refrigerator according to claim 10, further comprising:

a second path of the circulation pipe configured to feed the collected refrigerant from the evaporation collection tank to the cooling device.

12. The cryogenic refrigerator according to claim 1, further comprising:

a plurality of pumps; and at least one processor configured to control the plurality of pumps to move the refrigerant between the cooling device, an evaporation collection tank, and the measurement device.

13. The biomagnetic measurement apparatus according to claim 7, further comprising:

the transmission pipe is further configured to feed the liquid refrigerant from the cooling device to the measurement device, wherein the liquid refrigerant is used to cool the measurement device.

14. The biomagnetic measurement apparatus according to claim 7, further comprising:

an evaporation collection tank configured to collect the evaporated refrigerant and provide the collected evaporated refrigerant to the cooling device.

15. The biomagnetic measurement apparatus according to claim 14, further comprising:

a first path of a circulation pipe configured to feed the evaporated refrigerant from the measurement device to the evaporation collection tank.

16. The biomagnetic measurement apparatus according to claim 15, further comprising:

a second path of the circulation pipe configured to feed the collected refrigerant from the evaporation collection tank to the cooling device.

17. The biomagnetic measurement apparatus according to claim 7, further comprising:

a plurality of pumps; and at least one processor configured to control the plurality of pumps to move the refrigerant between the cooling device, an evaporation collection tank, and the measurement device.

* * * * *